US008823597B2

(12) United States Patent
Wang et al.

(10) Patent No.: US 8,823,597 B2
(45) Date of Patent: Sep. 2, 2014

(54) MULTI-SYSTEM MULTI-BAND RFID ANTENNA

(75) Inventors: Yong Wang, Shanghai (CN); Yuhang Zhao, Shanghai (CN)

(73) Assignee: Shanghai IC R & D Center Co., Ltd, Shanghai (CN)

( * ) Notice: Subject to any disclaimer, the term of this patent is extended or adjusted under 35 U.S.C. 154(b) by 181 days.

(21) Appl. No.: 13/634,244

(22) PCT Filed: Oct. 20, 2010

(86) PCT No.: PCT/CN2010/077921

§ 371 (c)(1), (2), (4) Date: Sep. 12, 2012

(87) PCT Pub. No.: WO2011/113278

PCT Pub. Date: Sep. 22, 2011

(65) Prior Publication Data

US 2013/0002502 A1 Jan. 3, 2013

(30) Foreign Application Priority Data

Mar. 19, 2010 (CN) ..... 2010 1 0128871
May 28, 2010 (CN) ..... 2010 1 0187387
Jul. 16, 2010 (CN) ..... 2010 2 0261343 U

(51) Int. Cl.
*H01Q 21/30* (2006.01)

(52) U.S. Cl.
USPC ..... 343/793

(58) Field of Classification Search
USPC ..... 343/793, 893, 870, 700 MS; 235/492
See application file for complete search history.

(56) References Cited

U.S. PATENT DOCUMENTS

| | | | | |
|---|---|---|---|---|
| 7,968,386 | B2 * | 6/2011 | Yamazaki et al. | 438/155 |
| 8,236,629 | B2 * | 8/2012 | Dozen et al. | 438/149 |
| 8,412,290 | B2 * | 4/2013 | Shamim et al. | 455/575.7 |
| 8,558,370 | B2 * | 10/2013 | Sugiyama et al. | 257/702 |
| 2007/0063057 | A1 * | 3/2007 | Masubuchi et al. | 235/492 |
| 2013/0002502 | A1 * | 1/2013 | Wang et al. | 343/793 |

* cited by examiner

*Primary Examiner* — Huedung Mancuso
(74) *Attorney, Agent, or Firm* — Anova Law Group, PLLC

(57) ABSTRACT

The present invention provides a multi-system multi-band RFID antenna, which comprises an on-chip antenna and at least one external antenna, wherein the on-chip antenna is arranged on RFID chip; the external antennas are arranged outside the RFID chip; and the RFID chip is provided with connection pads on the outer surface, wherein both the on-chip antenna and the external antennas are connected with the RFID chip through the connection pads. According to the multi-system multi-band RFID antenna of the present invention, the RFID chip can provide appropriate antennas for applications in different systems with different frequency bands, and can satisfactorily meet the need for RFID multi-system integration applications in the future.

18 Claims, 5 Drawing Sheets

| | | | |
|---|---|---|---|
| 12 | 15 | 40a | 12 |
| 11 | | 30a | 11 |
| 10 | | 20a | 10 |

MULTI-SYSTEM MULTI-BAND RFID ANTENNA

CROSS REFERENCE TO RELATED APPLICATIONS

This application is based upon and claims the benefit of priority from the prior Chinese Patent Application No. 201010128871.3 filed on Mar. 19, 2010, the prior Chinese Patent Application No. 201010187387.8 filed on May 28, 2010 and the prior Chinese Patent Application No. 201020261343.0 filed on Jul. 16, 2010 with Chinese State Intellectual Property Office, under 35 U.S.C. §119. The content of the above prior Chinese Patent Applications are incorporated herein by reference in its entirety.

FIELD OF THE INVENTION

The present invention relates to the technical field of integrated circuit fabrication, and particularly to a multi-system multi-band RFID (Radio Frequency IDentification) antenna.

BACKGROUND OF THE INVENTION

The antenna is a device which receives or transmits the front-end RF signal power in the form of an electromagnetic wave, and is an interface device between a circuit and the space for conversion between the guided wave and the free space wave energy. In a RFID system, the antenna is divided into two categories of an electronic tag antenna and a reader antenna, which are responsible for receiving and transmitting the energy, respectively. The current RFID systems mainly focus on the bands of low frequency (LF, 125 kHz-134 kHz), high frequency (HF, 13.56 MHz), ultrahigh frequency (UHF, 860-960 MHz) and microwave (MW, 2.45 GHz, 5.8 GHz). The principle and design for RFID system antenna in different operating frequency bands are fundamentally different. The gain and impedance characteristic of the RFID antenna may affect the operating distance of the RFID system, and the operating frequency band of the RFID system may in turn pose requirements regarding size and radiation loss of the antenna. Therefore, the design quality of the RFID antenna directly determines whether the overall RFID system is successful or not.

In a near-field antenna, as for the bands of low frequency (125 kHz-134 kHz) and high frequency (13.56 MHz), the system operates in near-field of the antenna. All of the energy required by the tag is obtained in an inductive coupling manner in the near field radiated by a coupling coil of the reader, and the operation manner is inductive coupling. In fact, the issue of propagation of electromagnetic wave is not involved in the near field, so that the design of antenna is relatively simple. Usually a coil antenna which is simple in process and low in cost is used. The coil antenna is indeed a resonant circuit. At the specified operating frequency, the coil antenna may produce resonance when the inductive impedance equals to the capacitive impedance.

In a far-field antenna, as for the bands of ultrahigh frequency (860 MHz-960 MHz) and microwave (2.45 GHz, 5.8 GHz), the reader antenna has to provide the tag with energy or wake up an active tag. The operation distance is relatively far, and generally is located in the far field of the reader antenna. According to the calculation equations of the far-field antenna, the electric field strength and the magnetic field intensity decay with the first power of the distance. The electric field and the magnetic field are orthogonal with each other in direction, and both fields are perpendicular to the propagation direction. The Poynting vector is a real number, and the electromagnetic field radiates energy in the form of electromagnetic wave. In this case, the design of antenna has a prominent effect on the performance of the system, and usually a dipole or microstrip patch antenna is used. The dipole antenna, also known as a symmetrical dipole antenna, is composed of two segments of straight wires which have the same thickness and length and are arranged in a straight line. A signal is fed in via two points in the middle, and a certain current distribution will be induced in two arms of the dipole. Such a current distribution will excite an electromagnetic field in the space around the antenna. Generally, a meander-line folded dipole antenna is used in the RFID electronic tag.

As for the existing RFID technology, since the applications are far less diversified and it is relatively difficult from the viewpoint of technology, the RFID chip usually has a unique operating frequency band, and only an antenna in a specific frequency band corresponds to the RFID chip. An attempt has been initiated in the field of mobile communication to develop the RFID to integrate the functions of communication, ID identification, and electronic payment. Therefore, the development of RFID technology in the future may exhibit the tendency of diversification in tag product, RFID multi-system integrated application, and the like. Thus, it is urgent to design and fabricate such a multi-system multi-band RFID antenna.

SUMMARY OF THE INVENTION

In order to solve the problem of a unique operating frequency band and application of the existing RFID antenna, the present invention provides a multi-system multi-band RFID antenna, so that requirements in different application scenarios are met by providing selection of antennas at several different frequency bands.

To achieve the afore-mentioned objects, the present invention provides a multi-system multi-band RFID antenna, which comprises an on-chip antenna and at least one external antenna; wherein the on-chip antenna is arranged on a chip, and the external antennas are arranged outside the chip; and the chip is provided with pads, wherein both the on-chip antenna and the external antennas are connected with the pads.

In an embodiment of the present invention, the afore-mentioned multi-system multi-band RFID antenna further comprises: a first insulating layer arranged on the chip, wherein the chip is provided with a first pad and a second pad; a second insulating layer arranged on the first insulating layer, wherein the on-chip antenna as well as a third pad and a fourth pad are provided in the second insulating layer; wherein the third pad is electrically connected with the first pad, and the fourth pad is electrically connected with the second pad; wherein the on-chip antenna is a coil antenna, two ends of which are connected with the third pad and the fourth pad, respectively, the third pad is located outside the coil, and the fourth pad is located inside the coil; and wherein each of two ends of the external antennas is connected with the third pad and the fourth pad, respectively.

In another embodiment of the present invention, the on-chip antenna comprises an on-chip antenna first metal layer and an on-chip antenna second metal layer, and the afore-mentioned multi-system multi-band RFID antenna further comprises: a first insulating layer arranged on the chip, wherein the chip is provided with a first pad and a second pad; a second insulating layer arranged on the first insulating layer, wherein the on-chip antenna first metal layer is arranged in the second insulating layer; a third insulating layer arranged on the second insulating layer; a fourth insulating layer arranged on the third insulating layer, wherein the on-chip antenna second metal layer as well as a third pad and a fourth pad are provided in the fourth insulating layer; wherein the third pad is electrically connected with the first pad, and the fourth pad is electrically connected with the second pad; wherein the on-chip antenna second metal layer is a spiral coil, both the third pad and the fourth pad are located outside the coil, an end of the spiral coil outside the coil is connected with the third pad, and an end of the spiral coil inside the coil is electrically connected with the fourth pad through the on-chip antenna first metal layer; and wherein each of two ends of the external antennas is connected with the third pad and the fourth pad, respectively.

The operating frequency of the on-chip antenna may be a high frequency, an ultrahigh frequency or a microwave; and the operating frequency of the external antennas may be a low frequency, a high frequency, an ultrahigh frequency or a microwave.

According to the multi-system multi-band RFID antenna of the present invention, the following beneficial effects will be achieved. The multi-system multi-band RFID antenna proposed in the present invention comprises an on-chip antenna which is connected with the chip directly, and one or more external antennas which are connected with the third and fourth pads. Both the on-chip antenna and the external antennas are provided with their own operating frequencies, and can exchange frequencies with each other within the defined range. As a result, the RFID chip can provide appropriate antennas for applications in different systems with different frequency bands, and can satisfactorily meet the need for RFID multi-system integration applications in the future.

BRIEF DESCRIPTION OF THE DRAWINGS

The multi-system multi-band RFID antenna of the present invention will be elucidated by reference to the following embodiments and the accompanying drawings, in which.

DETAILED DESCRIPTION OF THE EMBODIMENTS

The multi-system multi-band RFID antenna of the present invention will be described in further details hereinafter with respect to three embodiments and the accompanying drawings.

According to the present invention, the multi-system multi-band RFID antenna comprises an on-chip antenna and at least one external antenna. The on-chip antenna is arranged on the chip. The external antennas are arranged outside the chip. The chip is provided with connection pads on the outer surface. Both the on-chip antenna and the external antennas are connected with the chip through the connection pads.

In the present invention, the multi-system multi-band RFID antenna aims to provide selection of antennas at several different frequency bands, so as to meet requirements in different application scenarios. The operating frequency band of the on-chip antenna may be selected as a high frequency, an ultrahigh frequency or a microwave. Usually, the operating frequency band of the on-chip antenna is set as a default frequency band. The operating frequency band of the external antennas may be selected as a low frequency, a high frequency, an ultrahigh frequency or a microwave. The number of external antennas may be 1, 2 or 3, and the operating frequency band of the on-chip antenna is different from that of the external antenna. For example, when the on-chip antenna uses an ultrahigh frequency band, the operating frequency band of the external antennas may be selected from a low frequency, a high frequency or a microwave, and the operating frequency bands of multiple external antennas generally differ from each other. The external antenna may be a coil antenna, a dipole antenna or a microstrip patch antenna. When the external antenna is a coil antenna, the operating frequency may be a low frequency or a high frequency; when the external antenna is a dipole antenna, the operating frequency may be an ultrahigh frequency or a microwave; and when the external antenna is a microstrip patch antenna, the operating frequency may be an ultrahigh frequency or a microwave.

To facilitate structural comparisons, and to better demonstrate structural differences among RFID antennas in embodiments of the present invention, in all of the following three embodiments, the RFID antenna is of a structure comprising an on-chip antenna and two external antennas. A spiral coil antenna is used for the on-chip antenna which operates in a microwave frequency band. Besides, a coil antenna and a dipole antenna are used for each of two external antennas, which operate in a high frequency and an ultrahigh frequency band, respectively.

However, it is apparent for the skilled in the art to modify the number of external antennas and to recombine the operating frequency bands of the on-chip antenna and the external antennas. To this end, these modifications will not be described in detail.

First Embodiment

Figure 1:
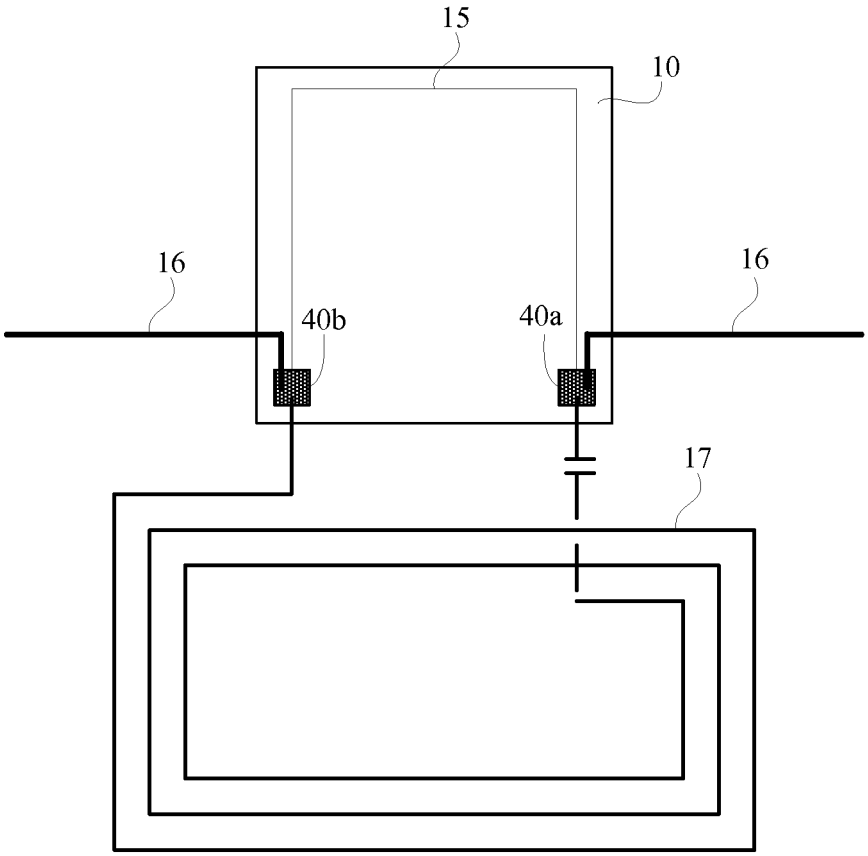
FIG. 1 is a schematic view showing a multi-system multi-band RFID antenna according to the first embodiment of the present invention.

Referring to FIG. 1, the multi-system multi-band RFID antenna of the present invention comprises an on-chip antenna 15 (for sake of clarity, the on-chip antenna is simplified in structure in FIG. 1) and two external antennas 16 and 17.

The on-chip antenna 15 is fabricated directly on the outer surface of the RFID chip 10. In the present embodiment, in a post-process processing manner, the on-chip antenna 15 is fabricated directly on the outer surface of the RFID chip 10 by means of a single Damascus process.

The RFID chip 10 is provided with two connection pads 40*a* and 40*b* on the outer surface, and two ends of the on-chip antenna 15 are soldered onto the two connection pads 40*a* and 40*b*, respectively.

The on-chip antenna 15 has a default operating frequency band. In the present embodiment, the on-chip antenna 15 has a default operating frequency of 2.45 GHz, which belongs to a microwave frequency band.

The external antenna 16 is formed outside the RFID chip 10. In the present embodiment, the external antenna 16 is a dipole antenna, and is composed of straight wires. Two ends of the dipole antenna are soldered onto two connection pads 40*a* and 40*b*, respectively. In other embodiments, a dipole antenna with different shapes may also be used, and the dipole antenna may be soldered onto the connection pads 40*a* and 40*b*. The external antenna 16 has an operating frequency of 915 MHz, which belongs to an ultrahigh frequency (UHF) band.

The external antenna 17 is also formed outside the RFID chip 10. Two ends of the external antenna 17 are soldered onto two connection pads 40*a* and 40*b*, respectively. In the present embodiment, the external antenna 17 is a coil antenna with an operating frequency of 13.56 MHz which belongs to a high frequency (HF) band.

The external antennas 16 and 17 are customized for the RFID chip 10. During operation of the RFID system, the RFID chip 10 automatically responds to the frequency specified by the external antennas 16 or 17 according to its internal clock.

Figure 2:
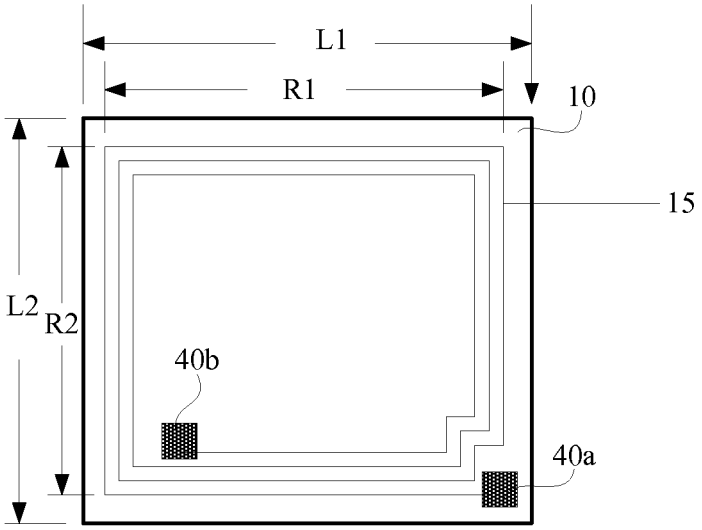
FIG. 2 is a schematic view showing an on-chip antenna in the multi-system multi-band RFID antenna according to the first embodiment of the present invention.

FIG. 2 is a structural view showing the on-chip antenna 15 in the present embodiment, in which the on-chip antenna 15 uses a spiral coil antenna.

The outer diameter of the on-chip antenna 15 (i.e., R1 and R2 in FIG. 2) is determined by the size of the RFID chip 10. During the design of the on-chip antenna 15, the maximum tolerable size is generally selected. The outer diameter of aid on-chip antenna 15 (R1, R2) is slightly smaller than that of the RFID chip 10 (i.e., L1 and L2 in FIG. 2).

In the present embodiment, the multi-system multi-band RFID antenna may operate at three frequencies of 2.45 GHz, 915 MHz and 13.56 MHz. That is, the multi-system multi-band RFID antenna has three operating frequency bands at a microwave, an ultrahigh frequency and a high frequency simultaneously. The chip 10 containing the multi-system multi-band RFID antenna can meet the requirements of operating at three frequencies of 2.45 GHz, 915 MHz and 13.56 MHz. In this way, at any exchanging frequency within the above frequency range, the chip 10 can provide an appropriate antenna in the right frequency band.

By using the multi-system multi-band RFID antenna of the present embodiment, an electronic tag or reader can be adapted not only for short distance identification, but also for long distance identification.

Second Embodiment

Figures 3, 4:
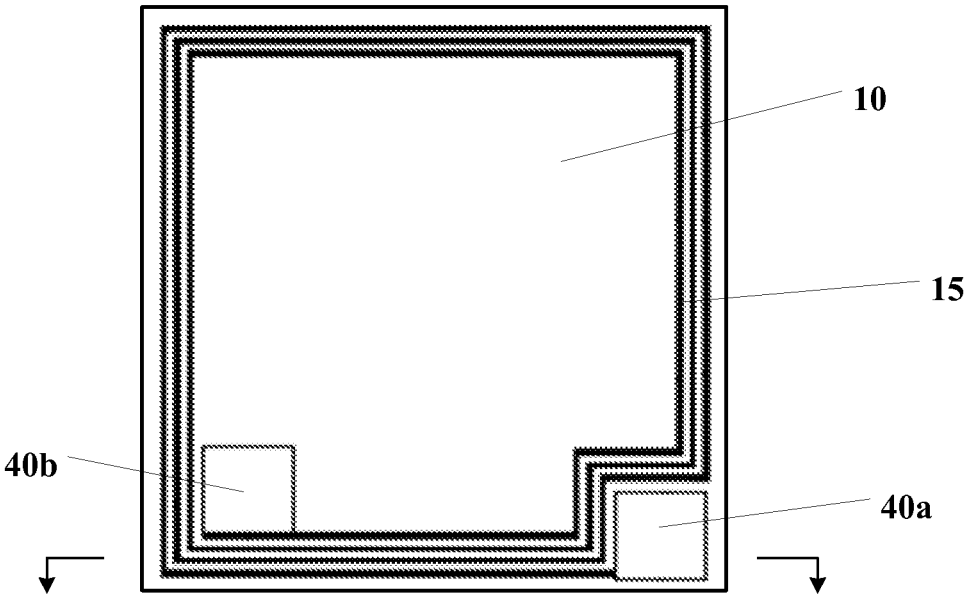
FIG. 3 is a structural top view showing an on-chip antenna in the multi-system multi-band RFID antenna according to the second embodiment of the present invention.
FIG. 4 is a cross-sectional view along the line A-A in FIG. 3.

Firstly, reference is made to FIG. 3, a structural top view showing the on-chip antenna in the multi-system multi-band RFID antenna according to the second embodiment of the present invention. As can be seen in FIG. 3, the on-chip antenna comprises a RFID chip 10, an on-chip antenna 15 on the chip 10, and a third pad 40*a* and a fourth pad 40*b* connected with the on-chip antenna 15. Here, the on-chip antenna 15 is a coil antenna. An end of the on-chip antenna outside the coil is connected to the third pad 40*a*, while an end of the on-chip antenna inside the coil is connected to the fourth pad 40*b*.

FIG. 4 is a cross-sectional view along the line A-A in FIG. 3, showing the partial cross-sectional structure of the multi-system multi-band RFID antenna according to the second embodiment of the present invention. As can be seen in FIG. 4, the RFID antenna comprises:

a first insulating layer 11 arranged on the RFID chip 10, wherein the RFID chip 10 is provided with two pads, i.e., a first pad 20*a* and a second pad (not shown);

a second insulating layer 12 arranged on the first insulating layer 11;

the on-chip antenna 15 arranged in the second insulating layer 12, wherein two pads, i.e., a third pad 40*a* and a fourth pad (not shown) are further arranged in the second insulating layer 12, wherein the third pad 40*a* and the first pad 20*a* are correspond with each other in orthogonal directions, and the fourth pad and the second pad are correspond with each other in orthogonal directions, wherein the third pad 40*a* is electrically connected with the first pad 20*a* through a first connection channel 30*a* formed in the first insulating layer 11, the fourth pad is electrically connected with the second pad through a second connection channel (not shown) formed in the first insulating layer 11, and both the first connection channel 30*a* and the second connection channel are filled with a metal; and a plurality of external antennas (not shown) connected with the third pad 40*a* and the fourth pad, respectively.

The method for manufacturing the afore-mentioned multi-system multi-band RFID antenna may comprise the following steps.

Firstly, a first insulating layer 11 is deposited on a RFID chip 10. The first insulating layer 11 may be an oxide layer, and may have a thickness in a range from 0.5 μm to 15 μm. Preferably, the first insulating layer 11 may have a thickness of 6 μm. A first pad 20*a* and a second pad are provided on the RFID chip 10 in advance.

Secondly, a portion of the first insulating layer 11 is etched until the first pad 20*a* and second pad are exposed, respectively, to form the first connection channel 30*a* and second connection channel. Both connection channels are filled with metals.

Thirdly, a second insulating layer 12 is deposited on the first insulating layer 11. The second insulating layer 12 may be an oxide layer, and may have a thickness in a range from 0.5 μm to 15 μm. Preferably, the second insulating layer 12 may have a thickness of 6 μm.

Fourthly, an on-chip antenna 15 is fabricated in the second insulating layer 12. Since the single Damascus process is applied, the on-chip antenna 15 has the same thickness as that of the second insulating layer 12, i.e., 6 μm. The operating frequency of the on-chip antenna 15 may be a high frequency (13.56 MHZ), an ultrahigh frequency (915 MHZ) or a microwave (2.45 GHZ or 5.8 GHZ). At the same time, a third pad 40*a* and a fourth pad are formed in the second insulating layer 12. The material for the on-chip antenna 15, the third pad 40*a* and the fourth pad may be Al or Cu. The third pad 40*a* and the fourth pad correspond one-to-one with the first pad 20*a* and the second pad in orthogonal directions. Namely, the third pad 40*a* and the first pad 20*a* are arranged at both ends of the first connection channel 30*a*, while the fourth pad and the second pad are arranged at both ends of the second connection channel, so that the corresponding pads are electrically with each other through metals filled in the connection channel.

Finally, multiple external antennas are connected with the third pad 40*a* and the fourth pad. The number of the external antennas may be 1, 2 or 3. The external antennas may have an operating frequency of a high frequency (13.56 MHZ), an ultrahigh frequency (915 MHZ) or a microwave (2.45 GHZ or 5.8 GHZ). The external antennas may be a coil antenna, a dipole antenna or a microstrip patch antenna. The coil antenna has an operating frequency of 13.56 MHZ, the dipole antenna has an operating frequency of 915 MHZ, 2.45 GHZ or 5.8 GHZ, and the microstrip patch antenna has an operating frequency of 915 MHZ, 2.45 GHZ or 5.8 GHZ.

Figure 5:
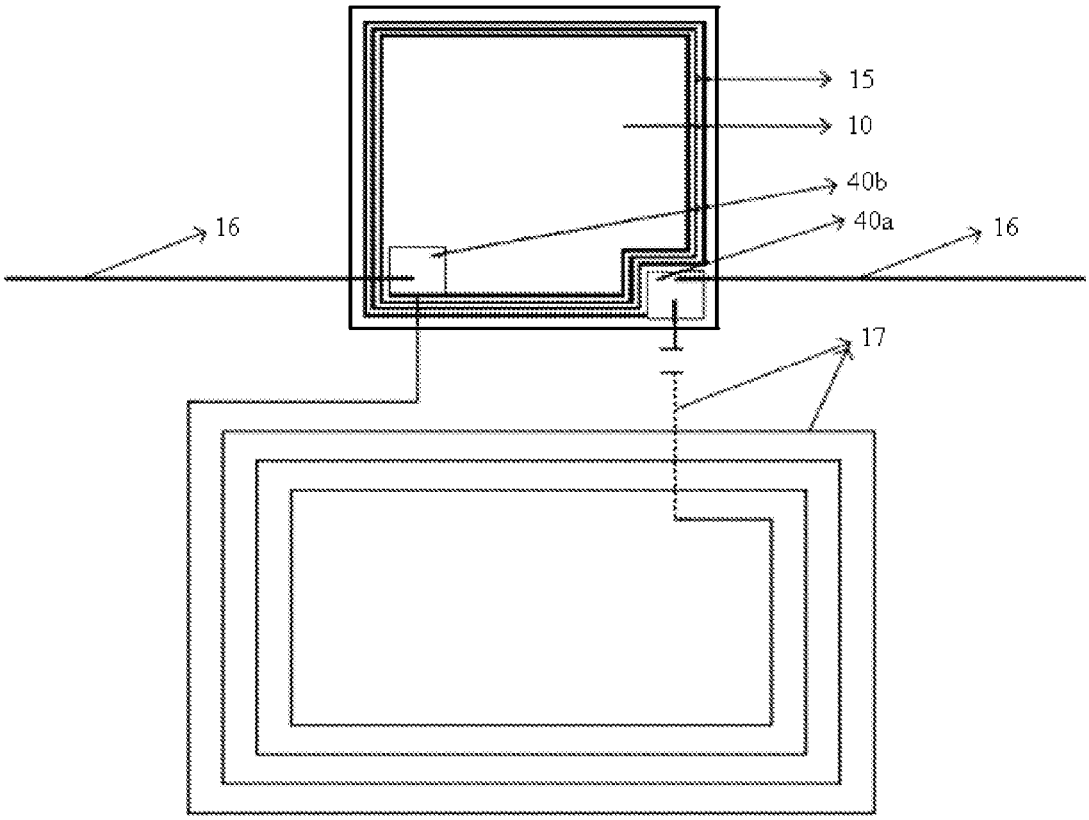
FIG. 5 is an overall structural view showing the multi-system multi-band RFID antenna according to the second embodiment of the present invention.

FIG. 5 is an overall structural view showing the multi-system multi-band RFID antenna according to the second embodiment. As can be seen in FIG. 5, the RFID antenna comprises the RFID chip 10, the on-chip antenna 15, and two external antennas 16, 17. The on-chip antenna 15 is a spiral coil antenna, both ends of which are connected to the third pad 40*a* and the fourth pad 40*b*. The third pad 40*a* is located outside the coil, while the fourth pad 40*b* is located inside the coil. Both external antennas 16, 17 are connected with the third 40*a* and fourth pads and 40*b*. In the present embodiment, the on-chip antenna 15 has an operating frequency of a microwave (2.45 GHz). The two external antennas 16, 17 customized for the RFID chip have operating frequencies of an ultrahigh frequency (915 MHz) and a high frequency (13.56 MHz), respectively. These external antennas 16, 17 are connected to the pads 40*a* and 40*b*, and can be applied to the surface of the chip 10 easily.

In the present embodiment, the multi-system multi-band RFID antenna is composed of three antennas with different frequency bands (13.56 MHz, 915 MHz and 2.45 GHz). A chip containing the RFID antenna can meet the requirements of operating at these three frequency bands. In this way, at any exchanging frequency within the afore-mentioned range, the chip can provide an appropriate antenna in the right frequency band.

The above-mentioned on-chip antenna may be fabricated with a Cu fabrication process by subjecting to the single Damascus process for several times. The on-chip antenna may use a spiral coil antenna, which operates in an inductive coupling manner and has an operating frequency in a frequency band of 2.45 GHz. The on-chip antenna is fabricated directly onto the chip, and the outer diameter is determined by the size of the chip. During designing the structure of the on-chip antenna, the maximum tolerable size is selected, provided that the outer diameter of the on-chip antenna spiral coil is slightly smaller than that of the chip. The two external antennas are fabricated after the on-chip antenna is completed. The external antennas are connected to the third and fourth pads, so that the external antennas can be applied to the surface of chip easily. In the present embodiment, the two external antennas are customized for the chip. Therefore, a chip, which contains a specific antenna, will respond to a frequency corresponding to the antenna. According to an internal clock, the chip will automatically respond to the frequency specified by the external antennas. In this embodiment, the two external antennas have an operating frequency of 13.56 MHz and 915 MHz, respectively. The external antenna with an operating frequency of 13.56 MHz is a coil antenna, while the external antenna with an operating frequency of 915 MHz is a dipole antenna.

Third Embodiment

Figure 6:
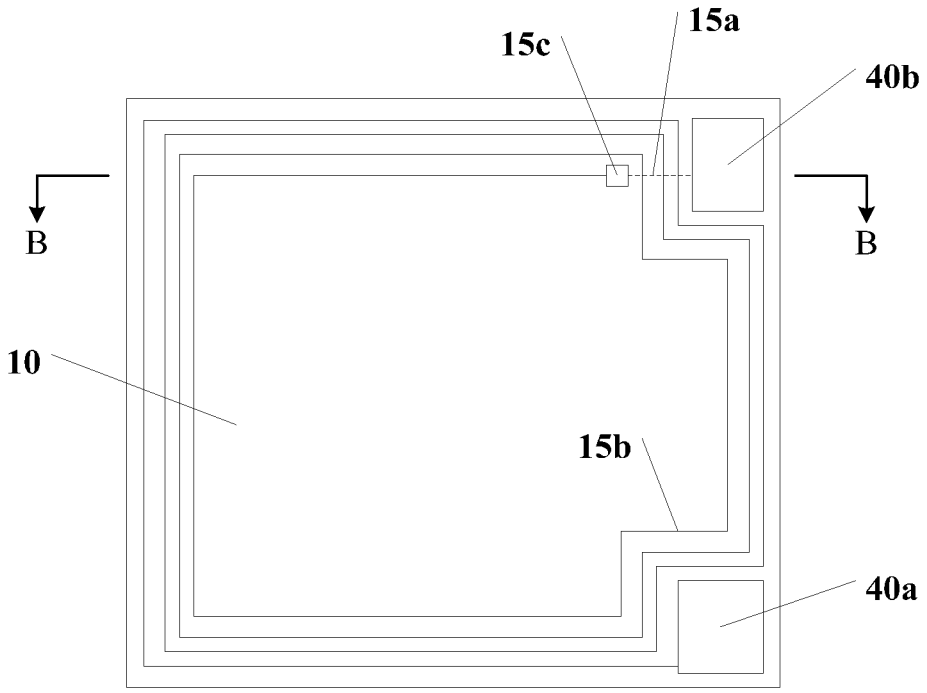
FIG. 6 is a structural top view showing an on-chip antenna in a multi-system multi-band RFID antenna according to the third embodiment of the present invention.

Firstly, reference is made to FIG. 6, which is a structural top view showing the on-chip antenna in the multi-system multi-band RFID antenna according to the third embodiment of the present invention. The on-chip antenna of the present embodiment distinguishes from those of the preceding two embodiments in that, the on-chip antenna is composed of an on-chip antenna first metal layer 15*a*, an on-chip antenna second metal layer 15*b*, and a third connection channel 15*c*. The on-chip antenna second metal layer 15*b* is a spiral coil. An end of the spiral coil outside the coil is connected directly with the third pad 40*a*, and an end of the spiral coil inside the coil is connected to the fourth pad 40*b* through the third connection channel 15*c* and the on-chip antenna first metal layer 15*a*. The structure of the multi-system multi-band RFID antenna according to the present embodiment will be illustrated in detail hereinafter by referring to FIG. 7.

Figure 7:
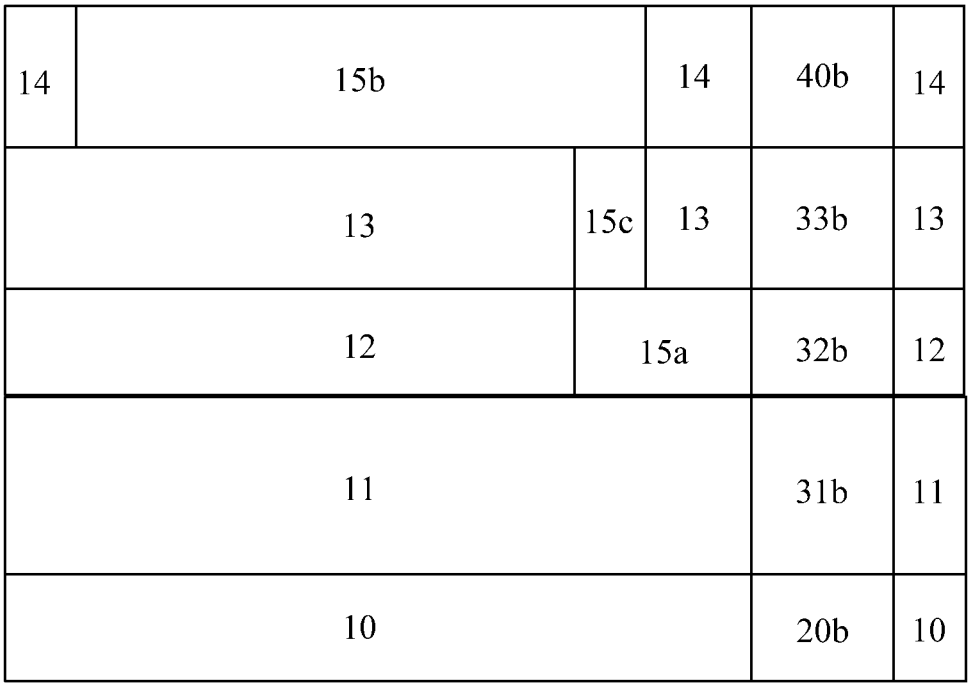
FIG. 7 is a cross-sectional view along the line B-B in FIG. 6.

FIG. 7 a cross-sectional view along the line B-B in FIG. 6. As can be seen from FIG. 7, the RFID antenna comprises:

a first insulating layer 11 arranged on the RFID chip 10, wherein the RFID chip 10 is provided with two pads, i.e., a first pad (not shown) and a second pad 20*b;* a second insulating layer 12 arranged on the first insulating layer 11;

an on-chip antenna first metal layer 15*a* arranged on the first insulating layer 11, wherein the on-chip antenna first metal layer 15*a* is arranged in the second insulating layer 12;

a third insulating layer 13 arranged on the second insulating layer 12;

a fourth insulating layer 14 arranged on the third insulating layer 13; and an on-chip antenna second metal layer 15*b* (i.e., a spiral coil) arranged in the fourth insulating layer 14, wherein in the fourth insulating layer 14 a third pad (not shown) and a fourth pad 40*b* are further provided, and the third pad and the first pad correspond one-to-one with the fourth pad 40*b* and the second pad 20*b* in orthogonal directions, wherein the third pad is connected with the first pad through a first connection channel which penetrates the first insulating layer 11, the second insulating layer 12 and the third insulating layer 13, respectively, the fourth pad 40*b* is connected with the second pad 20*b* through a second connection channel which penetrates the first insulating layer 11, the second insulating layer 12 and the third insulating layer 13, respectively, and both the first connection channel and the second connection channel are filled with metal materials. In particular, the first connection channel is formed by connecting with each other three first connection sub-channels which are formed in the first insulating layer 11, the second insulating layer 12 and the third insulating layer 13, respectively; and the second connection channel is formed by connecting with each other three second connection sub-channels 31*b*, 32*b*, 33*b* which are formed in the first insulating layer 11, the second insulating layer 12 and the third insulating layer 13, respectively. The openings of the three connection sub-channels may be connected completely (the mode shown in FIG. 7) or connected with each other in a staggered manner, provided that conduction can be established between the first pad and the third pad and between the second pad 20*b* and the fourth pad 40*b*. The third connection channel 15*c* is arranged in the third insulating layer 13. The on-chip antenna second metal layer 15*b* is a spiral coil, an end of which inside the coil is connected with the on-chip antenna first metal layer 15*a* through the third connection channel 15*c*. The third connection channel 15*c* is filled with metal materials. Each of the first insulating layer 11, the second insulating layer 12, the third insulating layer 13 and the fourth insulating layer 14 may be an oxide layer, and each of these insulating layers has a thickness between 0.5 μm and 15 μm. The material of the on-chip antenna first metal layer 15*a*, the on-chip antenna second metal layer 15*b*, the first connection channel, the second connection channel and the third connection channel 15*c*, and the third pad and the fourth pad 40*b* may be Al or Cu.

The operating frequency of the on-chip antenna may be a high frequency (13.56 MHz), an ultrahigh frequency (915 MHz) or a microwave (2.45 GHz or 5.8 GHz). Multiple external antennas are connected with the third and fourth pads 40*a* and 40*b*. The number of the external antennas is 1, 2 or 3. The external antenna may have an operating frequency of a high frequency (13.56 MHz), an ultrahigh frequency (915 MHz) or a microwave (2.45 GHz or 5.8 GHz). The external antenna may be a coil antenna, a dipole antenna or a microstrip patch antenna. The coil antenna has an operating frequency of 13.56 MHz, the dipole antenna has an operating frequency of 915 MHz, 2.45 GHz or 5.8 GHz, and the microstrip patch antenna has an operating frequency of 915 MHz, 2.45 GHz or 5.8 GHz.

Figure 8:
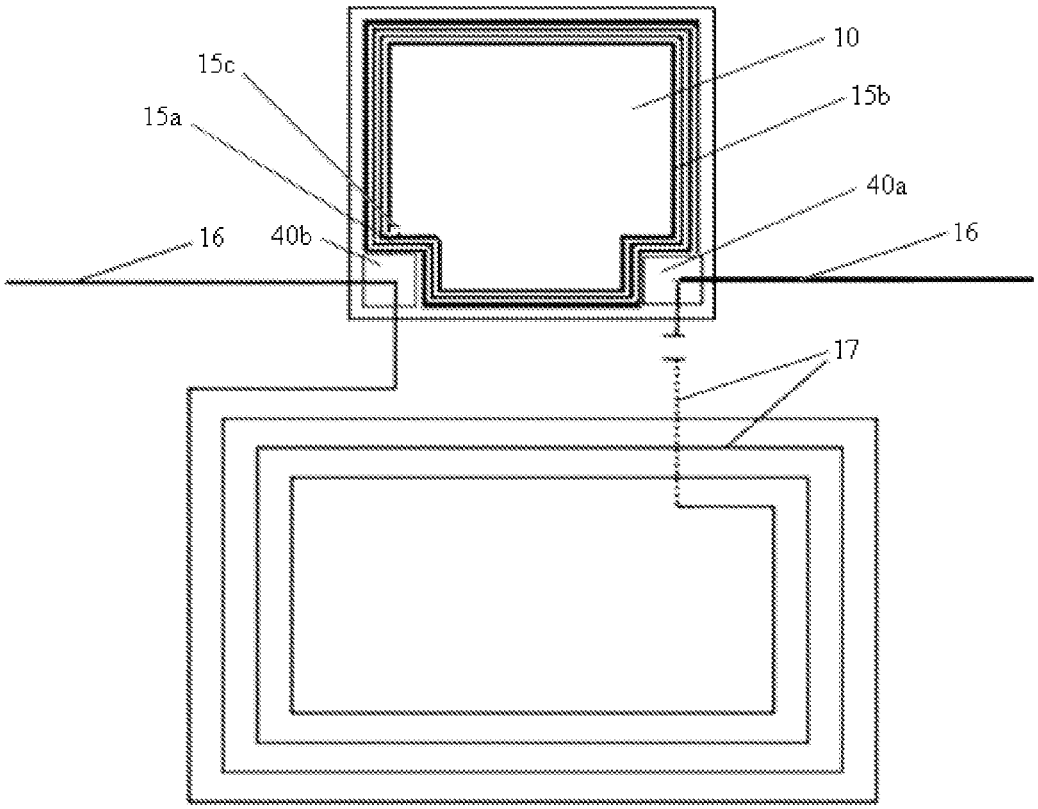
FIG. 8 is an overall structural view showing the multi-system multi-band RFID antenna according to the third embodiment of the present invention.

FIG. 8 is an overall structural view showing the multi-system multi-band RFID antenna according to the third embodiment of the present invention. As shown in FIG. 8, the RFID antenna comprises: the RFID chip 10; the third and fourth pads 40*a* and 40*b* for connecting the external antennas; the on-chip antenna (including the first on-chip antenna metal layer 15*a*, the second on-chip antenna metal layer 15*b* and the connection channel 15*c*) formed over the RFID chip 10; and two external antennas 16 and 17 customized for the RFID chip. The on-chip antenna has an operating frequency of 2.45 GHz, and the external antennas have operating frequencies of 915 MHz and 13.56 MHz. These external antennas are connected to the third and fourth pads 40*a* and 40*b*, so that they are easily applied to the surface of the chip.

In the present embodiment, the multi-system multi-band RFID antenna is composed of three antennas with different frequency bands (13.56 MHz, 915 MHz and 2.45 GHz). A chip containing the RFID antenna can meet the requirements of operating at these three frequency bands. In this way, at any exchanging frequency within the afore-mentioned range, the chip can provide an appropriate antenna in the right frequency band.

The on-chip antenna may be fabricated with a Cu fabrication process by subjecting to the single Damascus process for several times. The on-chip antenna commonly uses a coil antenna which operates in an inductive coupling manner, and the operating frequency is at the frequency band of 2.45 GHz. The on-chip antenna is fabricated directly onto the chip, and the outer diameter is determined by the size of the chip. During designing the structure of the on-chip antenna, the maximum tolerable size is selected, provided that the outer diameter of the on-chip antenna spiral coil is slightly smaller than that of the chip. The two external antennas are fabricated after the on-chip antenna is completed. The external antennas are connected to the third and fourth pads, so that they can be applied to the surface of chip easily. In the present embodiment, the two external antennas are customized for the chip. Therefore, a chip, which contains a specific antenna, will respond to a frequency corresponding to the antenna. According to an internal clock, the chip will automatically respond to the frequency specified by the external antennas. In this embodiment, one of the two external antennas has an operating frequency of 13.56 MHz, and the other has an operating frequency of 915 MHz. The external antenna with an operating frequency of 13.56 MHz is a coil antenna, while the external antenna with an operating frequency of 915 MHz is a dipole antenna.

Although the present invention has been disclosed as above with respect to the preferred embodiments, they should not be construed as limitations to the present invention. Various modifications and variations can be made by the ordinary skilled in the art without departing the spirit and scope of the present invention. Therefore, the protection scope of the present invention should be defined by the appended claims.

The invention claimed is:

1. A multi-system multi-band RFID antenna, comprising:

an on-chip antenna and at least one external antenna; the on-chip antenna is arranged on a chip, the external antennas are arranged outside the chip;

a first insulating layer arranged on the chip, wherein the chip is provided with a first pad and a second pad; and a second insulating layer arranged on the first insulating layer, wherein the on-chip antenna as well as a third pad and a fourth pad are provided in the second insulating layer;

wherein the third pad is electrically connected with the first pad, and the fourth pad is electrically connected with the second pad;

the on-chip antenna is a coil antenna, two ends of which are connected with the third pad and the fourth pad, respectively, the third pad is located outside the coil, and the fourth pad is located inside the coil; and each of two ends of the external antennas is connected with the third pad and the fourth pad, respectively.

2. The multi-system multi-band RFID antenna according to claim 1, wherein, the third pad is electrically connected with the first pad through a first connection channel formed in the first insulating layer, and the fourth pad is electrically connected with the second pad through a second connection channel formed in the first insulating layer.

3. The multi-system multi-band RFID antenna according to claim 1, wherein, each of the first insulating layer and second insulating layer is an oxide layer, and each of the insulating layers has a thickness between 0.5 μm and 15 μm.

4. The multi-system multi-band RFID antenna according to claim 1, wherein, the outer diameter of the on-chip antenna is slightly smaller than that of the chip.

5. The multi-system multi-band RFID antenna according to claim 1, wherein, the operating frequency band of the on-chip antenna is different from that of the external antenna.

6. The multi-system multi-band RFID antenna according to claim 1, wherein, the operating frequency of the on-chip antenna is a high frequency, an ultrahigh frequency or a microwave.

7. The multi-system multi-band RFID antenna according to claim 1, wherein, the material of the on-chip antenna is Al or Cu.

8. The multi-system multi-band RFID antenna according to claim 1, wherein, the on-chip antenna has a thickness of 0.5 μm-15 μm.

9. The multi-system multi-band RFID antenna according to claim 1, wherein, the operating frequency of the external antennas is a low frequency, a high frequency, an ultrahigh frequency or a microwave.

10. The multi-system multi-band RFID antenna according to claim 1, wherein, the number the external antenna is 1, 2 or 3.

11. The multi-system multi-band RFID antenna according to claim 1, wherein, the external antenna is a coil antenna, a dipole antenna or a microstrip patch antenna.

12. The multi-system multi-band RFID antenna according to claim 11, wherein, when the external antenna is a coil antenna, the operating frequency is a low frequency or a high frequency;

when the external antenna is a dipole antenna, the operating frequency is an ultrahigh frequency or a microwave; and when the external antenna is a microstrip patch antenna, the operating frequency is an ultrahigh frequency or a microwave.

13. A multi-system multi-band RFID antenna, comprising:

an on-chip antenna and at least one external antenna; the on-chip antenna is arranged on a chip, the external antennas are arranged outside the chip; the on-chip antenna comprises an on-chip antenna first metal layer and an on-chip antenna second metal layer;

a first insulating layer arranged on the chip, wherein the chip is provided with a first pad and a second pad;

a second insulating layer arranged on the first insulating layer, wherein the on-chip antenna first metal layer is arranged in the second insulating layer;

a third insulating layer arranged on the second insulating layer; and a fourth insulating layer arranged on the third insulating layer, wherein the on-chip antenna second metal layer as well as a third pad and a fourth pad are provided in the fourth insulating layer;

wherein the third pad is electrically connected with the first pad, and the fourth pad is electrically connected with the second pad;

wherein the on-chip antenna second metal layer is a spiral coil, both the third pad and the fourth pad are located outside the coil, an end of the spiral coil outside the coil is connected with the third pad, and an end of the spiral coil inside the coil is electrically connected with the fourth pad through the on-chip antenna first metal layer; and wherein each of two ends of the external antennas is connected with the third pad and the fourth pad, respectively.

14. The multi-system multi-band RFID antenna according to claim 13, wherein, each of the first insulating layer, the second insulating layer, the third insulating layer, and the fourth insulating layer is an oxide layer, and each of the insulating layers has a thickness between 0.5 μm and 15 μm.

15. The multi-system multi-band RFID antenna according to claim 13, characterized in that, the third pad is connected with the first pad through a first connection channel which penetrates the first insulating layer, the second insulating layer and the third insulating layer, respectively, the fourth pad is connected with the second pad through a second connection channel which penetrates the first insulating layer, the second insulating layer and the third insulating layer, respectively, and both the first connection channel and the second connection channel are filled with metal materials.

16. The multi-system multi-band RFID antenna according to claim 15, wherein, the first connection channel is formed by connecting with each other three first connection sub-channels which are formed in the first insulating layer, the second insulating layer and the third insulating layer, respectively; and the second connection channel is formed by connecting with each other three second connection sub-channels which are formed in the first insulating layer, the second insulating layer and the third insulating layer, respectively.

17. The multi-system multi-band RFID antenna according to claim 16, wherein, the openings of the three first connection sub-channels are connected completely or connected with each other in a staggered manner; and the openings of the three second connection sub-channel are connected completely or connected with each other in a staggered manner.

18. The multi-system multi-band RFID antenna according to claim 15, wherein, the on-chip antenna first metal layer is connected with the second connection channel;

a third connection channel is provided in the third insulating layer, through which an end of the spiral coil inside the coil is connected with the on-chip antenna first metal layer; and the third connection channel is filled with a metal material.

* * * * *